United States Patent [19]

Lieberman

[11] 4,231,833

[45] Nov. 4, 1980

[54] LAMINATED FRAME ASSEMBLY AND PROCESS

[76] Inventor: Aaron L. Lieberman, 426 Ashbourne Rd., Elkins Park, Pa. 19117

[21] Appl. No.: 953,024

[22] Filed: Oct. 20, 1978

[51] Int. Cl.[3] ..... B32B 31/00; A47G 1/08; A47G 1/12

[52] U.S. Cl. ..... 156/249; 40/158 R; 156/257; 156/263; 428/14; 428/41; 428/42

[58] Field of Search ..... 40/158 R; 156/289, 108, 156/252, 249, 257, 263; 428/13, 40, 42, 14, 41

[56] References Cited

U.S. PATENT DOCUMENTS

| | | | |
|---|---|---|---|
| 2,283,026 | 5/1942 | Yates | 206/460 |
| 2,942,368 | 6/1960 | Gale | 40/158 R |
| 2,984,922 | 5/1961 | Ladenburger et al. | 40/159 |
| 3,024,553 | 3/1962 | Rowley | 40/158 R |
| 3,184,873 | 5/1965 | Turner | 40/158 |
| 3,341,961 | 9/1967 | Shanks | 40/158 R |
| 3,442,041 | 5/1969 | Morgan | 40/158 R |
| 3,444,638 | 5/1969 | Jahn | 40/158 R |
| 3,505,140 | 4/1970 | Dunn | 156/249 |
| 3,670,434 | 6/1972 | Shibata et al. | 428/13 X |
| 3,857,192 | 12/1974 | Mascolo | 40/158 R |
| 4,023,292 | 5/1977 | Shibata et al. | 428/40 X |

*Primary Examiner*—George F. Lesmes
*Assistant Examiner*—Alexander S. Thomas
*Attorney, Agent, or Firm*—Weiser, Stapler & Spivak

[57] ABSTRACT

A process for framing and mounting an indicia sheet, such as a photograph, within a flexible planar frame which is part of a laminated frame assembly as well as the frame assembly itself and a method for making the assembly. The frame is attached to a transparent film, such as a plastic sheet, which has thereon an adhesive layer. Covering the adhesive layer is a release sheet from which a portion, corresponding approximately in size to the frame opening may be removed and used as a template for a photograph, which is then trimmed to size and inserted in its place. Thereafter, the remaining release sheet portion is removed and reversed in position to obtain an integral laminate.

38 Claims, 12 Drawing Figures

LAMINATED FRAME ASSEMBLY AND PROCESS

BACKGROUND OF THE INVENTION

Plastic sheet lamination of items such as photographs is known as a method to preserve, protect and mount the item. In general, two clear or slightly colored plastic sheets, each with an adhesive layer and a detachable release sheet, are provided. When lamination is desired, the release sheets are removed, the item is aligned between the respective exposed adhesive layers and the portions of the adhesive extending beyond the item are brought together under pressure.

Alternatively, only one plastic sheet with adhesive is used and a non-adhesive second substrate is used to mount the item.

However, prior techniques and materials pose disadvantages since upon removal of the release sheet, the exposed adhesive may complicate manipulation of the item to be mounted. This can result in its misalignment on one or both plastic adhesive sheets. Additionally, the exposed adhesive can result in handling problems resulting in misalignment of the two plastic sheets with respect to each ohter. Frames or laminates that are known include those set forth in U.S. Pat. Nos. 2,283,026, 2,942,368, 2,984,922, 3,024,533, 3,184,873, 3,341,961 and 3,505,140. In U.S. Pat. No. 3,505,140, a lamination unit is described as having a hinged pair of transparent sheets with adhesive faces opposed to each other and separated by a release sheet which has a release coating on both sides. One of the sheets may have a decorative border. However, use of the unit requires exposure of both entire adhesive faces which may cause errors in manipulation of the unit and misalignment of the article to be laminated between the borders.

SUMMARY OF THE INVENTION

The invention comprises generally a laminated framing assembly of a sheet through which the item to be framed can be viewed, a substantially planar, flexible frame attached to the sheet, an adhesive layer on the sheet and a release sheet thereover. The release sheet is divided into an inner and an outer portion, the inner portion being of substantially the same planar dimensions as the framed space of the frame. Removal of the inner portion allows its optional use as a template and placement of the object to be framed in its place without interference from adhesive beneath the outer portion.

In the preferred embodiment, a sheet of flexible, clear, plastic material is cut to desired size and has a flexible, decorative, peripheral border or frame affixed to the front face thereof. The rear face of the clear plastic sheet is covered with a suitable adhesive in known manner and a release sheet is adhered temporarily to the adhesive surface.

The release sheet is scored or otherwise treated to define an interior site or area which is sized to fit within substantially the area defined by the peripheral, decorative frame which is affixed to the front face of the clear plastic sheet.

In use, the inner portion of the release sheet defined by the scored line is first removed from the laminate of the clear plastic sheet, adhesive surface and release sheet to thus expose the adhesive surface defined within the decorative border or frame. The inner portion after removal can then be applied over a photograph, card or other indicia bearing sheet to serve as a template whereby the indicia bearing sheet can be trimmed exactly to the size of the template. The trimmed photograph is then applied directly to the exposed adhesive surface to form a permanent laminate therebetween wherein the indicia bearing surface is exposed to view through the clear plastic sheet and is peripherally encompassed by the decorative frame.

Then the remaining portion of the release sheet can simply be removed from association with the adhesive surface of the plastic sheet, reversed, and then reapplied to the adhesive surface to form a permanent laminate therewith. In this manner, a laminated frame assembly can be provided whereby the entire adhesive surface of an adhesive backed sheet can be fully covered in permanent manner and a picture or other indicia bearing sheet can be decoratively displayed within a decorative border.

It is an object of this invention to provide a method for making a framing and mounting assembly which can be used in mounting an item whereby only the adhesive which actually comes into contact with the item is initially exposed.

It is also an object of this invention to provide a mounting and framing assembly for laminating a planar item which requires only one adhesive sheeting.

A further object of the invention is a process for framing and mounting an object such as a photograph, wherein a pre-sized portion of release paper, normally disposed of in laminations, may be used as a template to obtain a perfectly sized photograph for use in the mounting assembly.

Other objects and a fuller understanding of the invention will be had by referring to the following description and claims of a preferred embodiment thereof taken in conjunction with the accompanying drawings wherein like reference characters refer to similar parts throughout the several views and in which:

DESCRIPTION OF THE PREFERRED EMBODIMENTS OF THE INVENTION

The laminated frame assembly comprises generally the following component parts:

a flexible sheet which is at least partially transparent to light;

a framing means defining a framed space and attached to the flexible sheet;

an adhesive layer adhered to one face of the flexible sheet; and a release sheet having a release face in contact with the adhesive layer, which is removable therefrom, i.e., is releasably adhered thereto, and which has an inner and an outer portion, the inner portion or section being substantially of the same dimensions as the framed space.

Figure 1:
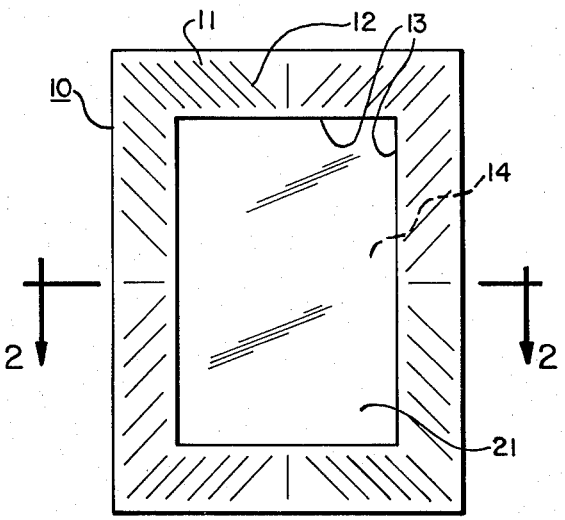
FIGS. 1 and 3 show front and rear elevational views, respectively, of a laminated frame assembly according to the invention.

Referring now to the drawings, there is shown in FIG. 1 a laminated frame assembly 10 comprising generally a front sheet 21 of clear, flexible plastic. A visible peripheral framing means 11 with optional embossing 12 is cemented or otherwise adhered to the sheet 21 and is configured to form a framing space which is defined by edges 13. Through the flexible sheet 21 within the area or "sight" defined within the decorative framing means 11, will be seen release sheet 14.

Figure 2A:
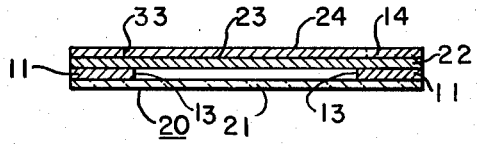
FIG. 2*a* is a cross sectional view similar to FIG. 2 showing a modified construction.
Figure 2:
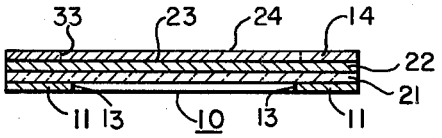
FIG. 2 is a cross sectional view taken along line 2—2 of FIG. 1 looking in the direction of the arrows and somewhat enlarged in cross sectional dimensions for purposes of illustration.

As illustrated in FIG. 2, the flexible sheet 21, hereinafter the "transparent sheet", can be as transparent to visible light as possible. However, it need only be transparent enough for the viewer to perceive the desired amount of information from a rearwardly mounted, indicia-bearing sheet. In the embodiment illustrated in FIGS. 1 and 2, the transparent sheet 21, through which an indicia-bearing sheet will ultimately be viewed, is bonded to the framing means 11. An adhesive layer 22 covers the underside of the sheet 21 and is fully protected by the removable release sheet 14. In the embodiment shown in FIG. 2*a*, the framing means 11 of frame assembly 20 is disposed on the opposite or inner side of the transparent sheet 21 and is covered by the adhesive layer 22. In both embodiments, the release sheet 14 has a release coating or surface 23 which allows removal from the adhesive of part or all of release sheet 14 in known manner. The opposite side 24 of the release sheet should not have a release coating or surface whereby a portion of the release sheet can be secured to the adhesive layer 22 when reversed, as hereinafter more fully set forth.

Figure 3:
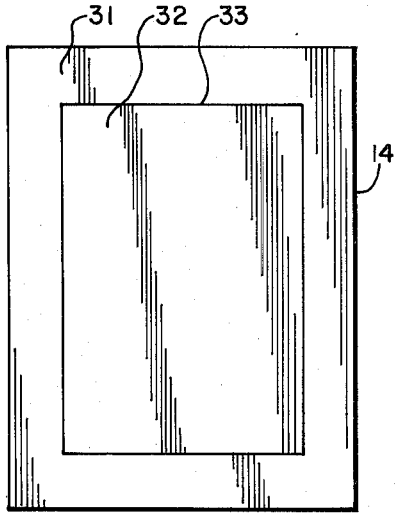

As shown more fully in FIG. 3, the release sheet 14 is divided into an outer, peripheral portion 31 and an inner portion 32 which are defined from each other by a partial or a full die cut line or separation 33.

The framing means 11 preferably is a substantially planar flexible film or sheet which is permanently affixed to the clear, flexible sheet 21. To provide a decorative appearance, the framing means 11 may have embossing 12 (FIGS. 1, 4 and 9), apertures 114 (FIG. 11) curved edges 113 (FIG. 11) or a relief pattern in order to provide a desired visual effect. The framed or viewing space defined by edges 13, 113 may be rectangular, oval, circular, irregular or patterned as illustrated in FIGS. 1, 4, 9 and 11. The outer boundary of the frame means 11 may also be other than straight as shown by edge 112 in FIG. 11. If desired, the framing means 11 may be designed to define more than one framed space, thereby to provide a mount for several photographs or indicate, in substantially two dimensional format, any desired three-dimensional picture frame.

The framing means 11 may be formed from any sheet forming material, and is preferably a metal foil, paper, polymer sheet, or a printing upon the transparent sheet. The framing means 11 may be single or multiple colors and may be formed of one or more separate parts. Thus, the frame may be a metal foil which is adhered to the transparent sheet 21 by adhesive or heat lamination with a border printed on the transparent sheet on the edge of the framed space or at the outer edge of the foil. Preferably, the frame is a metal foil, optionally embossed, which is adhesively applied to the face of the transparent sheet opposite the adhesive, as shown in FIG. 2.

The transparent sheet 21 in FIG. 2 and 2*a* is preferably flexible to permit manipulation without breakage, e.g., as with glass. It can be formed of a natural or synthetic polymer of known type which permits sufficient passage of the radiation with which the indicia-bearing sheet will ultimately be viewed. Thus, if the assembly is intended for use in mounting a photograph, the sheet 21 will be substantially transparent or clear to visible light. The sheet 21 may be tinted, roughened or otherwise modified to convey a desired visual effect. Further, the sheet 21 may be embossed to provide a texture and this may be done before or after the frame is applied thereto. The frame 11 may be adhesively applied or simply superimposed on the sheet 21 and the two can be heat laminated together while at the same time embossing both.

Figure 11:
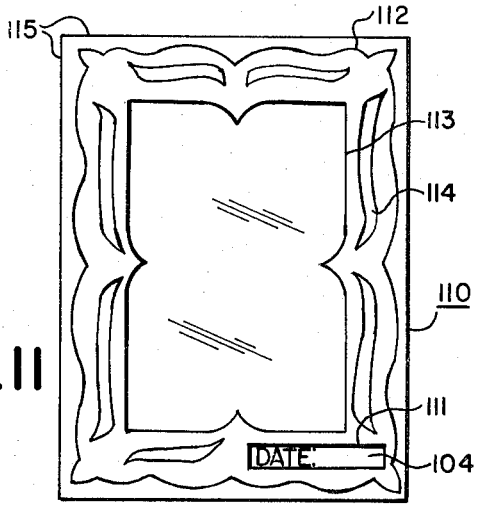

The transparent sheet 21 should extend at least as far as the framing means 11 whereby the two can be formed to the same peripheral size as shown in FIG. 1. Optionally, the transparent sheet edge 115 may extend peripherally outwardly from the edge 112 of the frame as depicted in FIG. 11.

In an alternative embodiment, two transparent sheets may be used to sandwich the framing means using suitable adhesives therebetween.

The adhesive layer 22 in FIGS. 2 and 2*a* may comprise generally a pressure sensitive adhesive composition which is tacky or sticky to the touch and essentially transparent to the radiation being used for viewing. Suitable adhesives are readily available and are well known to those skilled in the art of laminating clear plastic sheets utilizing release papers.

The release sheet 14, preferably a release paper, has a release coating or surface 23 by which the release sheet may be releasably joined to the transparent sheet. When the assembly before mounting is viewed from the rear as shown in FIG. 3, the release sheet 14 comprises an inner portion 32 and an outer peripheral portion 31 defined by the partial or full separation 33, which may be die cut. The separation line 33, also shown in FIGS. 2 and 2*a*, may be a line of perforations or other scoring to permit full removal of the inner portion 32 without disturbing the outer portion 31. Alternatively, the inner portion 32 may be fully distinct from the outer portion 31 and merely laid down upon the adhesive layer 22 in the space defined by the opening defined within the outer portion 31. Preferably, the separation 33 is a die cut or other separation in the release sheet 14 sufficient to allow removal of the inner and outer portions of the release sheet separately.

The inner portion 32 is substantially of the same shape and dimensions as the framed space of the frame. If the frame has two or more framed spaces, the release sheet 14 will preferably have the same number of removable inner portions 32. The inner portion or portions can be slightly smaller, larger or the same size as the framed space or spaces defined within the framing means 11. If an inner portion is smaller than its respective framed space, there will be provided a "matting" effect when the object to be framed is mounted according to the invention. If the separation 33 in FIG. 2 has the same dimensional outline as the framed space defined by the framing means edges 13 in FIG. 1, the object to be framed will exactly fit the defined space.

Figure 4:
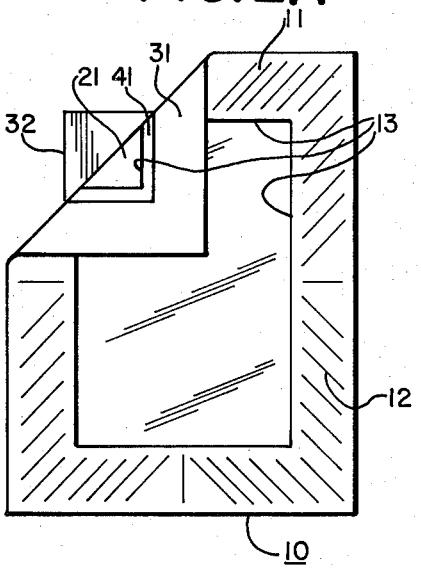
FIGS. 4 through 9 illustrate steps in the mounting and framing of a photograph according to the process of the invention.

In the preferred embodiment, the inner portion 32 of the release sheet 14 will preferably completely overlap, if only slightly, the framed space defined within the framing means 11 as shown in FIG. 4. This arrangement allows for minor errors in the preparation and alignment on the assembly of the object to be framed. Thus, slight irregularities on the edges of the object will not be seen by the viewer after mounting since they will be covered by the innermost edges 13 of the framing means 11.

In one embodiment of the invention, the release sheet 14 or at least the inner portion 32 thereof, can be clear or translucent and could have printed thereon an outline of the frame interior edges 13. This will allow the use of inner portion 32 both as a template and as a viewfinder whereby the user may know exactly what image will appear in the frame after full assembly. This embodiment will be advantageous if the framing is critical or if the shape or size of the inner portion differs substantially from that of the frames space defined within the framing means 11.

The release sheet 14 need only be as large as the transparent sheet 21 in order to cover and protect the adhesive layer 22 prior to framing and mounting. However, it may also extend outwardly beyond the transparent sheet on one or more sides or any section thereof if so desired. Thus, a tab (not shown) of release sheet 14 may be provided which extends beyond the edges of the transparent sheet 21 to allow easy removal of the outer release sheet portion 31. Further, the inner portion 32 may be provided with a tab (not shown) to facilitate its removal, such as by having the inner portion outline extend in the shape of a tab into and through the outer portion. In the embodiment illustrated in FIGS. 1 and 4, a release surface or coating of the inner portion 32 is initially visible through the flexible sheet 21 and it is this visible surface that is substituted upon affixing the image 51 to the assembly.

The following description of a mounting and framing process according to the invention is offered as an example of the use of the invention. Although the object to be mounted is illustrated as a photograph, it will be appreciated that the invention is not limited thereto. Accordingly, the mounted object can be a newspaper article, a letter, a diploma or substantially any planar object with perceivable indicia thereon. Although the photograph as illustrated is viewed with visible light and without magnification, it is apparent that the invention can be readily adapted for the viewing of objects by infrared or other radiation.

The framing assembly is prepared by coating a transparent, flexible sheet, preferably a polymer sheet, with an adhesive, preferably a pressure sensitive adhesive of well known composition. Before or after this coating, a framing means 11 having a framing space defined therewithin is adhered to the transparent sheet. After the adhesive is applied, the release side of a release sheet 14 is overlaid to cover completely the adhesive layer 22. The release sheet 14, as hereinbefore described comprises an inner portion 32 and an outer portion 31, the inner portion being detachable from the outer portion and having substantially the same dimensions as the framing space defined within the framing means.

Preferably, and as depicted in FIG. 4, the inner portion 32 of the release sheet extends further outwardly from the center of the assembly than the edges 13 of the framing means 11. Thus, upon removal of the inner portion 32 from outer portion 31, there is exposed an edge portion 41 of the back side of framing means 11 and portion of the transparent sheet 21 corresponding to the framed space, both coated with the adhesive layer 22.

Figure 5:
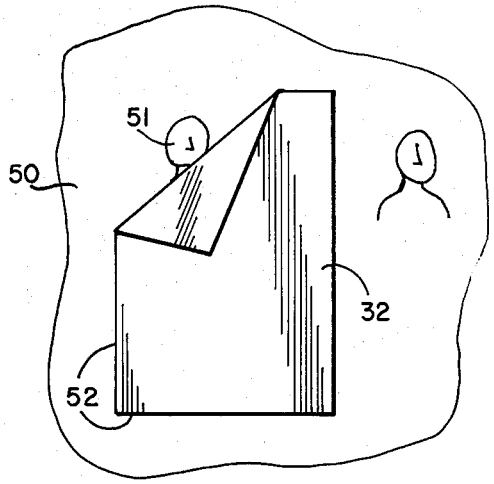

FIG. 5 illustrates the use of inner portion 32 as a template in obtaining the correctly sized segment of photograph 50. In use, the inner portion 32 is aligned over a photograph 50 or other indicia containing sheet to cover the image 51. Thereafter, the edges 52 of inner portion 32 can be used as a template to inscribe lines on the photograph or a cutting instrument can directly be used along edges 52 to cut out the photograph segment 61 to be framed. The inner portion 32 is then discarded.

Figure 6:
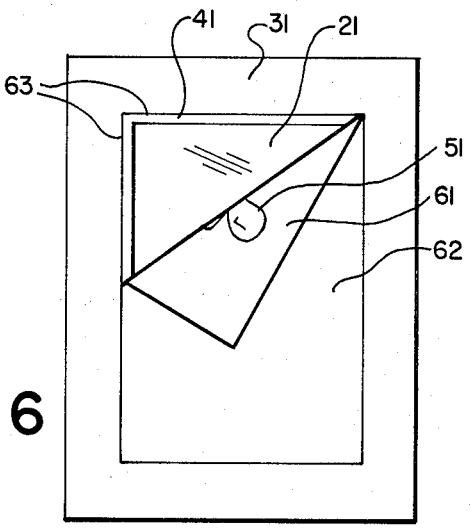

FIG. 6 depicts placement of the photograph segment 61 containing the image 51 upon the assembly. Since the segment 61 has been made by using inner portion 32 as a template, it will fit exactly into the space formerly occupied by the portion 32 as defined within the outer portion 31. The photo segment 61 is then pressed down upon the exposed portion of the adhesive layer 22 at the rearward side of the transparent sheet 21 and rearward of the inner edge portion of the frame back 41. After this step, only the back 62 of the photograph segment 61 is exposed to the atmosphere.

Still referring to FIG. 6, it should be noted that the invention provides a physical boundary for the correct placement of photograph segment 61. That is, the inner edges of outer portion 31 act as retaining walls and as a placement guide when the photograph segment 61 is aligned with an inserted into the space left by the removal of the inner portion 32.

Figure 7:
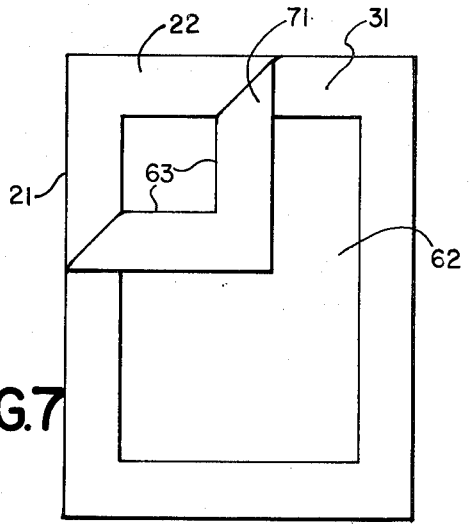

FIG. 7 illustrates the final step in the lamination process. The outer portion 31 is first stripped away from the assembly, thus exposing release surface 71 thereof. Also exposed is the adhesive 22 at the peripheral back portion of the flexible sheet 21. Since the photograph segment 61 is laminated to the adhesive 22 and is distinct from the outer portion 31, it remains on the assembly, exposing only its back 62.

Figure 8:
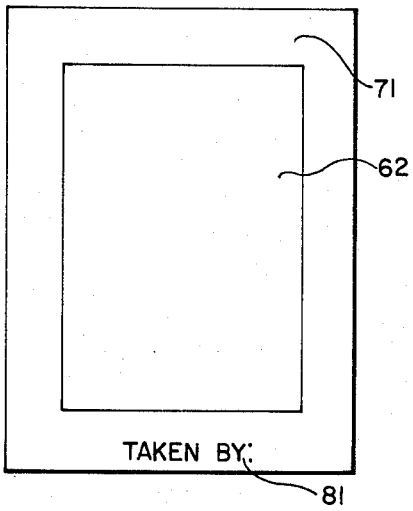

After full removal of the outer portion 31 as indicated in FIG. 7, the assembly may be mounted upon any desired substrate (not shown). For example, it may be adhered, by the adhesive 22 exposed by the removal of outer portion 31, to a wall, to a photograph album, to a clear, translucent or opaque polymeric sheet or the like. In the preferred embodiment, the outer portion 32 is simply turned over and applied to the assembly by adhering its non-release type face to the exposed adhesive 22. In this embodiment, the back of the resulting assembly will be as shown in FIG. 8. In this manner, a laminated photograph mount with all adhesive surfaces covered may be obtained with only one clear plastic sheet utilizing a significant portion of the release sheet. Viewing the back of the completed assembly, one will see a peripheral outer area of a smooth release surface 71 and an inner area which actually is the back 62 of a photograph segment 61. However, if desired, the assembly after removal of the outer portion 31 may simply be affixed to a wall, album, page, etc. (all not shown).

Further, printed indicia 81 may be provided on the release surface 71 such that upon reversal of the outer portion 31, the printed indicia will be visible and one may apply added indicia, such as the date the photograph was taken, to the assembly.

Figure 9:
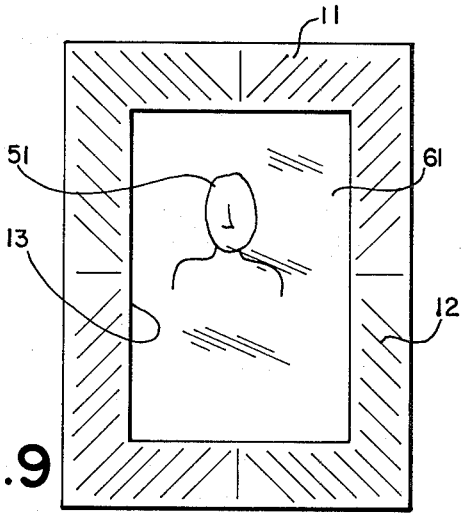

The front of the completed assembly is shown in FIG. 9. The photograph segment 61 will be framed by the framing means 11 and the image 51 will be in alignment with the framing space provided.

Modifications can be made to the method used for making the assembly, the assembly itself as well as the process described for mounting image bearing sheets without departing from the spirit and scope of the invention as exemplified below.

Figure 10:
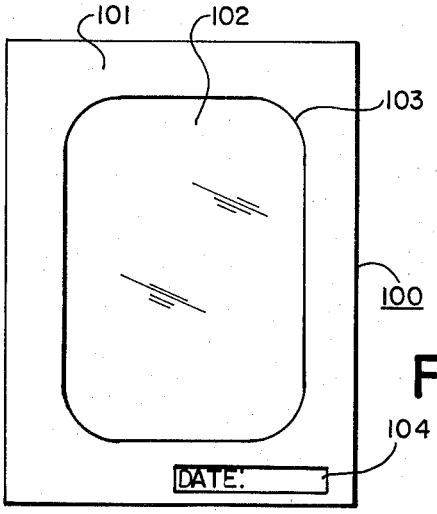
FIGS. 10 and 11 illustrate other embodiments of framing units according to the invention.

FIGS. 10 and 11 indicate a modification of the invention wherein indicia may be inscribed by hand and permanently laminated within the completed assembly in addition to the indicia bearing sheet. The back of an assembly 100 ready for framing is shown in FIG. 10. The non-release surface of the outer portion 101 is provided with a space 104 which is designated for the application of indicia. For example, one framing a photograph may want to provide the assembly with a permanent indication of the date the photograph was taken, which date can be viewed from the front simultaneously with the photograph. Many photographs are supplied with dates during processing but these dates are often printed on the back and such placement may prove inconvenient after a photograph is affixed in an album.

After the outer portion 101 shown in FIG. 10 is removed and reversed in the manner hereinbefore described the hand applied inscription in space 104 will be seen from the front through a similarly situated and aligned aperture 111 which is provided in the frame of completed assembly 110 in FIG. 11.

FIGS. 10 and 11 further indicate other possible modifications to the assembly and process of the invention. In FIG. 10, the inner and outer portions 102 and 101 respectively of the release sheet are distinguished by partial or full separation or score lines 103 which are non-rectangular. Thus, the shape of the inner portion 102 can be regular, e.g. rectangular, oval or circular, or it can be irregular, e.g. the same shape but perhaps different dimensions as that of the framed space defined by the curved and shaped edge 113 shown in FIG. 11.

Further modifications may be obtained by providing apertures, optionally of a decorative shape, in the framing means as exemplified by apertures 114 in FIG. 11. The color and texture seen by the viewer of the assembly after mounting and through the apertures 114 will be those of the substrate on which the assembly is adhered after removal of the outer portion 101 in FIG. 10. If the non-release side of the release sheet is provided with a color and/or texture, such will be perceived by the viewer through the apertures 114 in the assembly 110 after the outer portion 101 of the release sheet is reversed and used as the substrate.

FIG. 11 depicts additionally other modifications that can be made, such as the use of a transparent sheet with edges 115 that extend farther outwardly than the outer edges 112 of the framing means.

It can be seen from the above that the methods and products of the present invention provide an excellent preservation and mounting for objects such as photographs. However, it will be understood that various modifications and adaptions of the invention can be made by those skilled in the art without departing from the spirit of the invention and, accordingly, the invention is not be taken as limited by the above description.

What is claimed is:

1. A process for framing and mounting an indicia-bearing sheet comprising the steps of (a) removing a portion of a release sheet from a framing assembly, said framing assembly comprising
a flexible sheet which is at least partially transparent to light,
a framing means attached to said flexible sheet,
an adhesive layer adhered to one face of said flexible sheet, and
said release sheet having a first face, in contact with said adhesive layer, which is removable from the adhesive layer and an opposite face, wherein the framing means has a framed space substantially of the same dimensions as the release sheet portion removed from the assembly;

(b) laminating to the assembly, in the space created by the removal of the release sheet portion in step (a), an indicia-bearing sheet which indicia is visible through said flexible sheet through the face opposite said adhesive layer;

(c) removing the remaining release sheet from the assembly; and (d) adhering a substrate to the adhesive exposed by step (c).

2. The process of claim 1, wherein said framing means is an image of a frame printed on the flexible sheet.

3. The process of claim 1, wherein said framing means is a metal foil, a paper sheet or a sheet of a polymer.

4. The process of claim 1, wherein said framing means is attached to the flexible sheet on the face opposite the adhesive layer.

5. The process of claim 1, wherein said framing means is attached to the flexible sheet between the flexible sheet and the adhesive layer.

6. The process of claim 1, wherein the release sheet portion removed in step (a) has dimensions slightly greater than the framed space of said framing means.

7. The process of claim 1, wherein said opposite face of the release sheet is more adherent than the first face to the adhesive layer and the substrate adhered to the assembly in step (d) is said release sheet removed in step (c), the face of said substrate adhered being the opposite face of the release sheet.

8. The process of claim 7, wherein the framing means has a second space whereby indicia on said opposite face of the release sheet are visible through the flexible sheet and the second space after step (d).

9. The process of claim 1, wherein said release sheet is scored in a pattern corresponding to the release sheet portion removed in step (a).

10. The process of claim 1, wherein said release sheet is a release paper having a release coating on said first face.

11. The process of claim 1, wherein between steps (a) and (b), said release sheet portion removed in step (a) is used as a template to obtain said indicia-bearing sheet.

12. A process for mounting a photograph comprising the steps of (a) removing a portion of a release paper from a framing assembly, said framing assembly comprising
a metal foil frame having a framed space attached to
a transparent polymeric flexible sheet,
an adhesive layer on the face of said flexible sheet opposite said frame, and
said release paper having a first face, in contact with said adhesive layer, which is removable from the adhesive layer and an opposite face which is more adherent to the adhesive than the first face, wherein the release paper portion removed has dimensions slightly greater than the framed space of said frame;

(b) using the release paper portion removed in step (a) as a template to obtain a photograph having dimensions corresponding to the removed release paper portion;

(c) laminating to the assembly, in the space created by the removal of the release paper portion in step (a), the photograph obtained in step (b) with the image of the photograph in contact with the adhesive layer;

(d) removing the remaining release paper from the assembly; and (e) laminating the release paper removed in step (d) to the assembly with the opposite face thereof in contact with the adhesive layer.

13. The process of claim 12, wherein said frame has a second space and further comprising the step of applying indicia to said remaining release paper, in alignment with said second space, before step (e) whereby said indicia is visible through the second space in the frame after step (e).

14. The process of claim 13, wherein the release paper is scored in a pattern corresponding to the release paper portion removed in step (a).

15. A method for preparing a framing assembly for the framing and mounting of an indicia-bearing sheet comprising the steps of (i) attaching a framing means having a framing space to one face of a flexible sheet which is at least partially transparent to light;

(ii) adhering an adhesive layer on a face of said flexible sheet; and (iii) laminating the release face of a release sheet to the adhesive layer on the side opposite said flexible sheet, said release sheet having an inner and an outer portion, said inner portion being detachable from the outer portion and having substantially the same dimensions as said framed space.

16. The method of claim 15, wherein said framing means is an image of a frame printed on the flexible sheet.

17. The method of claim 15, wherein said framing means is a metal foil, a paper sheet or a sheet of a polymer.

18. The method of claim 15, wherein said framing means is attached to the flexible sheet on the face opposite the adhesive layer.

19. The method of claim 15, wherein said framing means is attached to the flexible sheet between the flexible sheet and the adhesive layer.

20. The method of claim 15, wherein said inner portion of the release sheet has dimensions slightly greater than the framed space of said framing means.

21. The method of claim 15, wherein the face of said release sheet opposite the release face is more adherent than the release face to the adhesive layer.

22. The method of claim 21, wherein said opposite face has a section thereof designated for applied indicia and said framing means has a second space in alignment with said designated section such that upon removal of the outer portion and its subsequent lamination to the assembly, the applied indicia may be viewed through said second space of the framing means.

23. The method of claim 15, wherein said release sheet is scored between said inner and outer portions.

24. The method of claim 15, wherein said release sheet is a release paper having a release coating on one face thereof.

25. A framing and mounting assembly comprising a flexible sheet which is at least partially transparent to light, a framing means having a framed space, which framing means is attached to said flexible sheet, an adhesive layer adhered to one face of said flexible sheet, and a release sheet having a release face, in contact with said adhesive layer, which is removable from the adhesive layer, and having an opposite face, wherein said release sheet has an inner portion and an outer portion, said inner portion being detachable from the outer portion and defining a space having substantially the same dimensions as the frame space.

26. The assembly of claim 25, wherein said framing means is an image of a frame printed on the flexible sheet.

27. The assembly of claim 25, wherein said framing means is a metal foil, a paper sheet or a sheet of a polymer.

28. The assembly of claim 25, wherein said framing means is attached to the flexible sheet on the face opposite the adhesive layer.

29. The assembly of claim 25, wherein said framing means is attached to the flexible sheet between the flexible sheet and the adhesive layer.

30. The assembly of claim 25, wherein said inner portion of the release sheet has dimensions slightly greater than the framed space of said framing means.

31. The assembly of claim 25, wherein the face of said release sheet opposite the release face is more adherent than the release face to the adhesive layer.

32. The assembly of claim 31, wherein said opposite face has a section thereof designated for applied indicia and said framing means has a second space in alignment with said designated section such that upon removal of the outer portion and its subsequent lamination to the assembly, the applied indicia may be viewed through said second space of the framing means.

33. The assembly of claim 25, wherein said release sheet is scored between said inner and outer portions.

34. The assembly of claim 25, wherein said release sheet is a release paper having a release coating on one face thereof.

35. The assembly of claim 25 having template means for determining the size of an object to be framed and mounted in said assembly.

36. The assembly of claim 35 wherein said template means is the inner portion of said release sheet.

37. The assembly of claim 35 having means for aligning said sized object within the said assembly.

38. The assembly of claim 37 wherein said aligning means is the inner periphery of the outer portion of said release sheet.

* * * * *